United States Patent [19]

Vincent et al.

[11] Patent Number: 4,642,725

[45] Date of Patent: Feb. 10, 1987

[54] DC SOLENOID ACTUATOR CIRCUITS

[75] Inventors: David Vincent, Burgess Hill; Aloysius G. Mahabir, Crawley, both of United Kingdom

[73] Assignee: Vent-Axia Limited, United Kingdom

[21] Appl. No.: 783,417

[22] Filed: Oct. 3, 1985

[30] Foreign Application Priority Data

Oct. 4, 1984 [GB] United Kingdom ..... 8425120

[51] Int. Cl.[4] ..... H01F 7/18

[52] U.S. Cl. ..... 361/154

[58] Field of Search ..... 361/154, 155

[56] References Cited

U.S. PATENT DOCUMENTS 4,454,558 6/1984 Huddart ..... 361/155 X
4,481,555 11/1984 Yoshida et al. ..... 361/155
4,539,619 9/1985 Hill ..... 361/155 X

FOREIGN PATENT DOCUMENTS 2159369 6/1972 Fed. Rep. of Germany .
3230254 3/1983 Fed. Rep. of Germany .
3232217 3/1984 Fed. Rep. of Germany .
3305674 8/1984 Fed. Rep. of Germany .
100573 9/1973 German Democratic Rep. .
1323517 7/1973 United Kingdom .
2104739 3/1983 United Kingdom .

*Primary Examiner*—Michael L. Gellner
*Attorney, Agent, or Firm*—Toren, McGeady and Goldberg

[57] ABSTRACT

This invention relates to DC solenoid actuator circuits.

A DC solenoid winding located to act on an armature, is connected across a rectifier connected to an AC supply. A capacitor is provided across the winding so that the initial voltage applied to the solenoid winding is greater than the average actuating voltage.

One terminal of the rectifier is connected to the AC supply via a switch which can either inolude in that circuit a capacitor or shunt that capacitor. The switch is mechanically linked to the armature of the solenoid winding so that at a predetermined point during the stroke of the armature the switch is operated to include the capacitor in the circuit so as to lower the actuating voltage for the solenoid.

3 Claims, 3 Drawing Figures

DC SOLENOID ACTUATOR CIRCUITS

BACKGROUND OF THE INVENTION

This invention relates to DC solenoid actuator circuits particularly for actuating the shutters of fans and appliances.

DESCRIPTION OF THE PRIOR ART

Solenoid actuator circuits are well known and are typically used in commerical fan applications to actuate louvre shutters to inhibit backdraught. Normally, the solenoids used are AC solenoids which are prone to noise caused by AC induced hum and vibration and such solenoids are mechanically harsh in operation.

SUMMARY OF THE PRESENT INVENTION

An object of the present invention is to overcome the disadvantage of such AC solenoid circuits by replacing the AC solenoid by a DC solenoid and by controlling the operation of the DC solenoid to improve the performance of the circuit.

According to the present invention there is provided a DC solenoid actuator circuit comprising a DC solenoid for operating an armature; a rectification circuit connectable to an AC supply to provide a DC actuating voltage for the solenoid, first means connected to the solenoid to raise said actuating voltage for initially operating the armature; and second means connected to lower the actuating voltage at a predetermined point during the armature stroke.

It has been found that the force characteristic of the DC solenoid is enhanced and modified by boosting its initial pull-in by substantially raising the voltage across the winding above that produced by the mains voltage value, such as by connecting a capacitor in parallel across the winding of the DC solenoid, and then by substantially reducing the solenoid voltage below that produced by the mains voltage value, when the solenoid armature is in its fully engaged position, or whilst in an intermediate position before final engagement. This can be achieved by means of a switch device in combination with a capacitor which substantially reduces the input voltage to the solenoid below that produced by the AC mains level.

In a preferred embodiment of the invention, the switching device is mechanically linked to the solenoid armature and is actuated when the solenoid winding is energised, but alternatively, the switch may be actuated at any point during the state of the solenoid armature by other means. The voltage reduction can be achieved by alternative means such as by resistive, electrical or electronic devices.

BRIEF DESCRIPTION OF THE DRAWINGS

The invention will now be described by way of example only with particular reference to the accompanying drawings wherein.

DETAILED DESCRIPTION OF THE PREFERRED EMBODIMENTS

Figure 1:
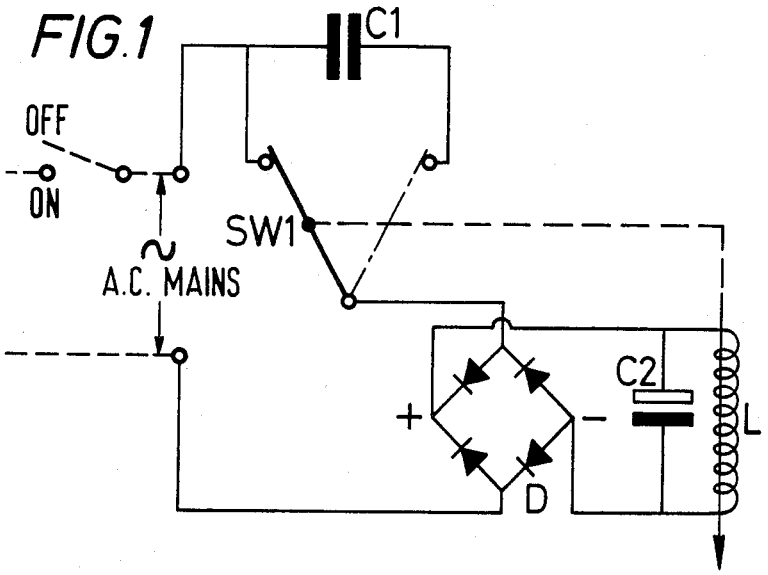
FIG. 1 is a circuit diagram of one embodiment of the solenoid voltage control circuit.

Referring to the circuit diagram of FIG. 1, a bridge rectifier D is connected across the AC mains supply to produce a DC actuating voltage for the winding L of the DC solenoid connected across the output terminals of the rectifier D. A smoothing and voltage boost capacitor C2 is connected across the winding L to boost the initial pull-in of the armature of the solenoid by raising the voltage across the winding above the normal actuating voltage produced by the mains voltage value. A further capacitor C1 is connected between one terminal of the AC mains supply and the input of the rectifier D via a switch SW1 mechanically linked to the armature of the DC solenoid, to substantially reduce the solenoid voltage below the actuating voltage produced by the input mains voltage, when the solenoid armature is in its fully engaged position or whilst in an intermediate position prior to final engagement.

These substantial changes in input voltage to the solenoid winding from above to below the actuating voltage produced by mains level are during the stroke of the solenoid armature and result in force characteristics considerably higher than those normally obtained in a solenoid of comparative size for continous operation and without incurring unacceptable solenoid temperatures typical in known systems. By adjustment of the component values, solenoid winding resistance and switching position, a wide variety of force characteristics can be achieved.

Figure 2:
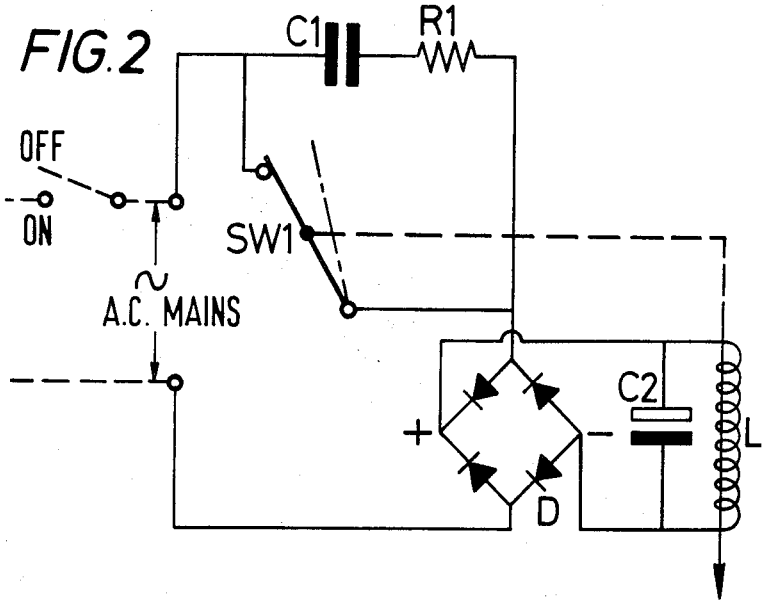
FIG. 2 illustrates an alternative embodiment of the solenoid actuator circuit.
Figure 3:
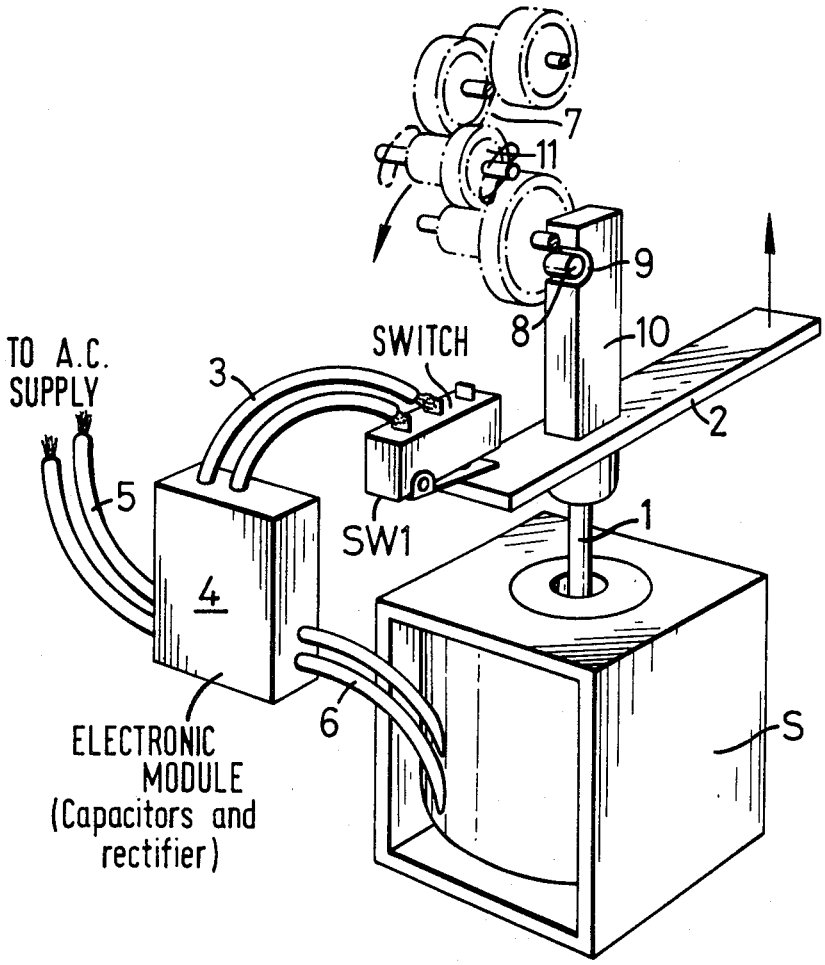
FIG. 3 is a schematic perspective view of the overall apparatus for controlling the actuation of the louvre shutter of a fan or appliance.

FIG. 2 illustrates an alternative circuit showing a different manner of reducing the solenoid voltage. Common components in FIGS. 1 and 2 have common identifying numerals. In FIG. 2, the capacitor C1 is continuously connected to an input of the rectifier D via an arc quenching resistor R1. The effect of this capacitor is shunted by the switch SW1 until the solenoid armature mechanically linked to the switch removes the shunt so that capacitor C1 acts as in FIG. 1.

When the circuit of FIG. 1 is used for the actuation of the louvre shutter of a fan or appliance, a mechanical damping arrangement shown in FIG. 2 can be used for the return of the shutter being actuated.

Referring to FIG. 2, showing the shutter operating system the armature 1 of the DC solenoid S is connected to a shutter operating lever 2 which is pushed manually in one direction to actuate the shutter. The switch SW1 is mounted on the lever 2 and connected by leads 3 to an electronic module 4 which houses the capacitors C1,C2 and the rectifier D. Further leads 5,6, connect the module 4 to the AC mains supply and the winding of the DC solenoid 5 respectively. The damping arrangement actuates a gear train 7 having a projection 8 on one gear which is adapted to engage in a notch or recess 9 in an extension 10 of the solenoid armature 1, the gear 11 being displaced from the gear train 7 when the armature is actuated in response to energisation of the solenoid winding L and re-engaging on the return stroke.

It will be appreciated that the invention is susceptible to considerable modification and is not to be deemed limited to the particular circuit features described by way of example only and as applicable to appliances other than fans.

A feature of the damping arrangement illustrated is that it is not engaged during the operating stroke of the armature, thereby allowing maximum energy to be applied to the opening of the shutter, and the damper only engages during the return stroke or closing of the shutter. However, the damping arrangement could be employed in both operating and return strokes to damp thereby both opening and closing of the shutter.

What we claim is:

1. A DC solenoid actuator circuit comprising:

a DC solenoid suitable for operating an armature;

a rectification circuit connectable to an AC supply and connected to the DC solenoid to apply a DC actuating voltage for the solenoid;

capacitor means connected to said solenoid, the impedance values of the capacitor means and solenoid being selected to produce resonance whereby an over-rated actuating voltage is applied thereto to operate the armature; and switch means connected by a mechanical link with the armature and actuated at a predetermined point during the initial armature stroke to interconnect with the rectification circuit by way of reducing means to reduce said over-rated voltage to acceptable operating voltage for said DC solenoid.

2. A circuit as claimed in claim 1, wherein the reducing means comprises a capacitor, said switch means being disconnected from shunting the capacitor to reduce the applied voltage.

3. A circuit as claimed in claim 1, wherein damping means is provided to damp the armature movement in one or both directions of its strokes.

* * * * *